US006681421B2

(12) United States Patent
Carroll

(10) Patent No.: US 6,681,421 B2
(45) Date of Patent: Jan. 27, 2004

(54) APPARATUS AND METHOD OF USING A PICTURE DISPLAYING CRIB BUMPER

(76) Inventor: Mary T. Carroll, 204 Daytona St., Atlantic Beach, NY (US) 11509

( * ) Notice: Subject to any disclaimer, the term of this patent is extended or adjusted under 35 U.S.C. 154(b) by 0 days.

(21) Appl. No.: 09/935,301

(22) Filed: Aug. 22, 2001

(65) Prior Publication Data

US 2002/0026669 A1 Mar. 7, 2002

Related U.S. Application Data

(60) Provisional application No. 60/228,435, filed on Aug. 28, 2000.

(51) Int. Cl.[7] ..... A47D 15/00

(52) U.S. Cl. ..... 5/424; 5/946; 434/428; 446/227; 40/727; 40/776

(58) Field of Search ..... 5/424, 425, 427, 5/946; 434/365, 428, 430; 446/227; 40/586, 725, 727, 654.07, 775, 776

(56) References Cited

U.S. PATENT DOCUMENTS 4,670,923 A * 6/1987 Gabriel et al. ..... 5/424
4,890,346 A * 1/1990 Rist ..... 5/946
5,410,765 A * 5/1995 Youngblood ..... 5/946
5,606,816 A 3/1997 Schwartz
5,615,434 A 4/1997 Cracchiolo et al.
5,651,152 A 7/1997 Ritchie et al.
5,933,885 A 8/1999 Glassford
5,991,943 A 11/1999 Morris
6,026,528 A * 2/2000 Pina ..... 5/946
6,170,101 B1 * 1/2001 McCloud ..... 5/424
6,178,573 B1 * 1/2001 Wagner et al. ..... 5/424

OTHER PUBLICATIONS

"Say Cheese—IQ Baby Crib Bumper Pad" GeniusBabies.com (undated).*

Eliot, Lise, Ph.D., *What's Going on in There?How the Brain and Mind Develop in the First Five Years of Life*, Chapter 9, *Wiring up the Visual Brain*, A Bantam Book, Sep. 1999, pp. 196–227.

* cited by examiner

*Primary Examiner*—Frederick L. Lagman
(74) *Attorney, Agent, or Firm*—Morgan & Finnegan LLP

(57) ABSTRACT

The present invention is a photodisplaying crib bumper which is positioned in the interior walls of a crib and allows such things, as, photographs and drawings to be removably displayed therein.

37 Claims, 9 Drawing Sheets

APPARATUS AND METHOD OF USING A PICTURE DISPLAYING CRIB BUMPER

This application claims the benefit of provisional No. 60/228,438 filed on Aug. 28, 2000.

FIELD OF THE INVENTION

This invention relates generally to bedding capable of containing and displaying various objects within itself. More particularly, the invention relates to a crib bumper cover with a means for holding, containing and displaying various items, therein. Most particularly, the invention relates to a baby crib bumper cover with a picture holding means within the bumper cover itself, enabling such things as photographs, drawings, or flexible non-breakable mirrors to be removably displayed therein.

BACKGROUND OF THE INVENTION

Primary caretakers, members of the health profession and early childhood educators are all interested in educational tools which enhance the psychological development of children within their natural environment. In the early stages of child development, children are shaped by their visual association. Visual experience is crucial for the correct development of certain brain circuits. Increasing a child's visual stimulus from birth may enhance their ability and better equip them to carry out various visually oriented and visually dependent tasks. Furthermore, repeating some visual images over and over allows a child to become visually familiar with those specific images and also, allows the child to easily incorporate these images into their lives. An in-depth analysis of visual exposure in connection to the mental development during the early childhood years is described in Dr. Lisa Eliot's book "*What's Going On In There? How the Brain and Mind Develop in the First Five Years of Life*" Copyright 1999, Bantam Book which is herein Incorporated by Reference.

Since, newborns are to some extent color blind and can only view the shape of an object, infants innately prefer to gaze at patterned objects rather then plain ones or featureless surfaces. In addition, the human face and face-like arrangements of shapes fascinate infants. The infant brain prefers to gaze at the human face more than the faces of other species and over inanimate objects.

To continuously enhance the development of children, products which will allow caretakers to personalize and select the visual images that children view daily in the natural surrounding of their crib are needed. However, many of the educational tools and products available in today's market for early childhood development contain set images for children to view (e.g. crib bumper fabric covers have cows, bells, angels, ABC blocks, cartoon characters, etc., all inlayed into the fabric) which are not changeable. Therefore, caretakers have to settle for devices that cannot be tailored to their child's individual growth. This is frustrating for caretakers who want to customize and personally select different images over time during the early formative years of their development.

Additionally, caretakers are constantly purchasing new teaching tools for different stages of a child's development. Moreover, many educational tools are gender specific or depict a particular subject matter to coincide with the decor of the child's room such that if the decor of the child's room should change or a child of the opposite gender uses the surrounding, an entirely new product would have to be purchased. Also, existing child bedding may not be customized and manipulated to reflect the different stages of the child's mental growth and developmental cycles. It therefore would be desirable for caretakers to be able to customize the child's natural environment to reflect the child's developmental stages and to enhance their visual perception within the early childhood years.

Existing crib bedding fabrics or bumpers do not provide for the interchanging and displaying of different graphics of the face or other objects chosen and customized by the caretakers within the crib bumper.

SUMMARY OF THE INVENTION

The present invention relates to an interchangeable graphics displaying crib bumper. More particularly, the present invention relates to a picture displaying crib bumper fabric cover. The invention provides the caretaker with the ability to tailor visual stimulus that a child is exposed to daily while in a crib, wherein a crib is defined as any baby containment system.

Thus, one feature of the invention is that it offers versatility in many dimensions. Caretakers can change the graphics to coincide with the developmental progression of the infant. The caretaker can control the content of the graphics displayed to improve the visual association and mental development in the child.

These and other objects of the invention will be apparent to those skilled in the art from the following detailed description of the invention and the accompanying drawings.

BRIEF DESCRIPTION OF THE DRAWING

The invention will be described in greater detail below with references to the attached drawings of which:

FIG. 1A is an overall view of the present invention for the picture displaying crib bumper, where the bumper is capable of both displaying pictures and encasing the bumper batting to protect the baby's body from injurious contact with the crib (i.e. bumping into the crib rails).

DETAILED DESCRIPTION OF THE INVENTION

The invention is a crib bumper with a means for holding objects positioned along the interior surrounding of a crib. The bumper of this invention comprises a fabric cover comprising of at least one receptacle for displaying an object, preferably, a plurality of receptacles are present along one or more of the sections of the crib bumper. In addition, the receptacles are preferably placed in a position on the bumper within view of an infant placed in the crib. The interior surrounding of a crib includes but is not limited to the walls, guard and rails of the crib. The invention is attached and horizontally or vertically positioned along at least one portion of the interior side wall, guard or rail of the crib. Thus, the crib bumper can be any size that would allow it to fit into the interior of a crib. As used herein, "crib" is any enclosure, suitable for containing an infant, having walls to which the bumper of this invention can be affixed.

The crib bumper is preferably made of a soft, non-toxic, washable substance, which is acceptable for infant bedding. The crib bumper's fabric cover comprises a receptacle for holding and displaying the object.

Figure 1A:
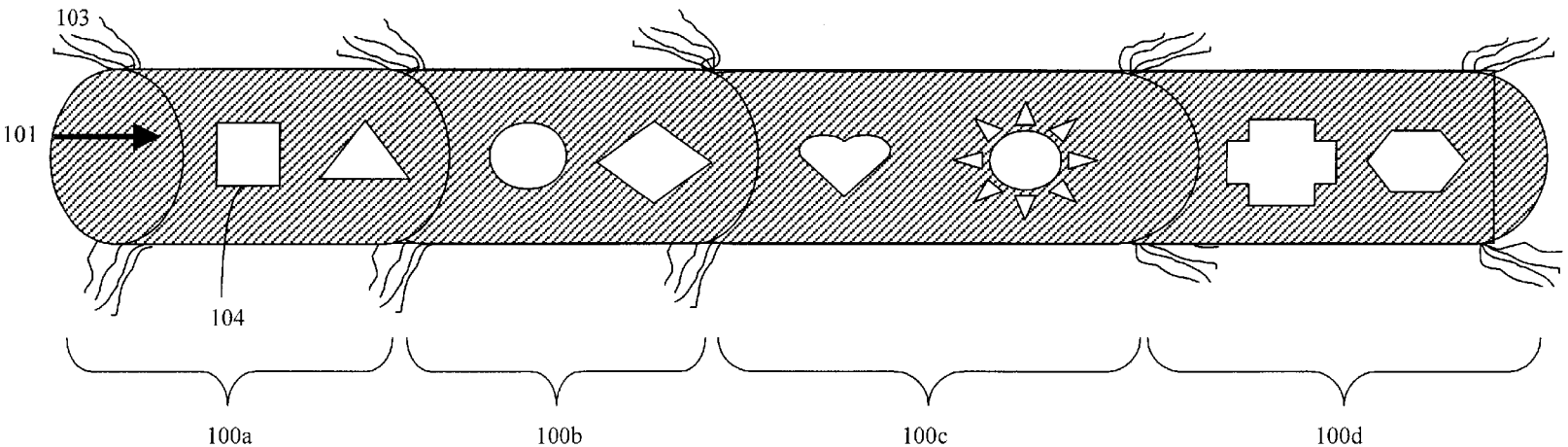
FIG. 1A illustrates the frontal view of an embodiment of the invention.

FIG. 1A illustrates the frontal view of an embodiment of the crib bumper where the fabric cover is capable of encasing bumper batting. The bumper batting is a soft non-toxic and washable material filling the fabric cover. Preferably, the bumper batting is a plush, foam or cottony fabric. The bumper batting minimizes the incident or degree of injury to a young child in a crib. In FIG. 1A, the crib bumper's fabric cover encompasses the bumper batting. The bumper batting is inserted into the crib bumper's fabric cover through an opening 101 (refer to FIG. 1C-102 for the rear view) in the fabric cover and the bumper batting is kept in place inside the fabric cover by a holding means FIG. 1C-102, which includes but is not limited to the following or a combination of the following: zippers, buttons, overlapping fabric, strings, Velcro-like fastener or snaps. The fabric cover can easily be removed and separated from the bumper batting.

The crib bumper's fabric cover also has an attachment means 103, preferably linen strings, which allows a person to secure the bumper cover to the interior surrounding of the crib. Moreover, the crib bumper has a display means or a receptacle 104 for displaying objects through the fabric cover. This receptacle 104 is a non-toxic, clear, pliable, flexible substance and preferably made out of a soft plastic derivative, most preferably a soft plastic. The receptacle 104 is the place for inserting the photographs.

Figure 1B:
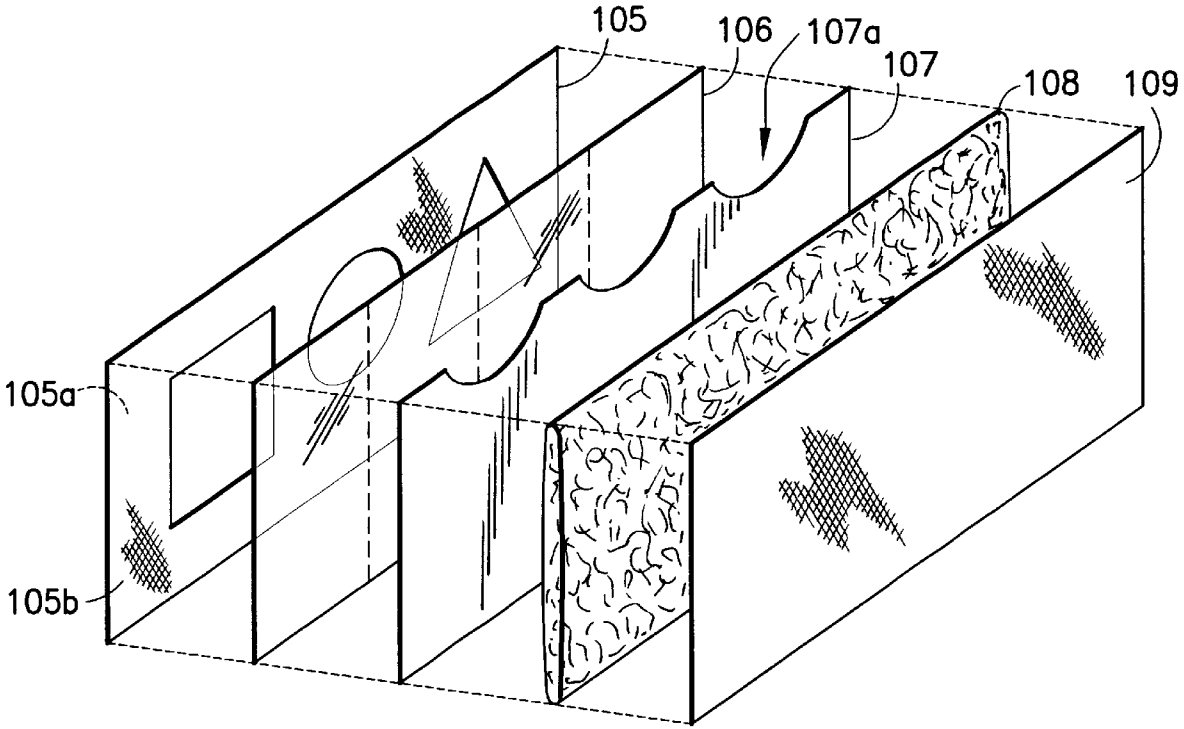
FIG. 1B illustrates a partially exposed perspective view of the present invention where the invention is comprised of different layers, such that a picture holding unit or pocket exists.
Figure 1C:
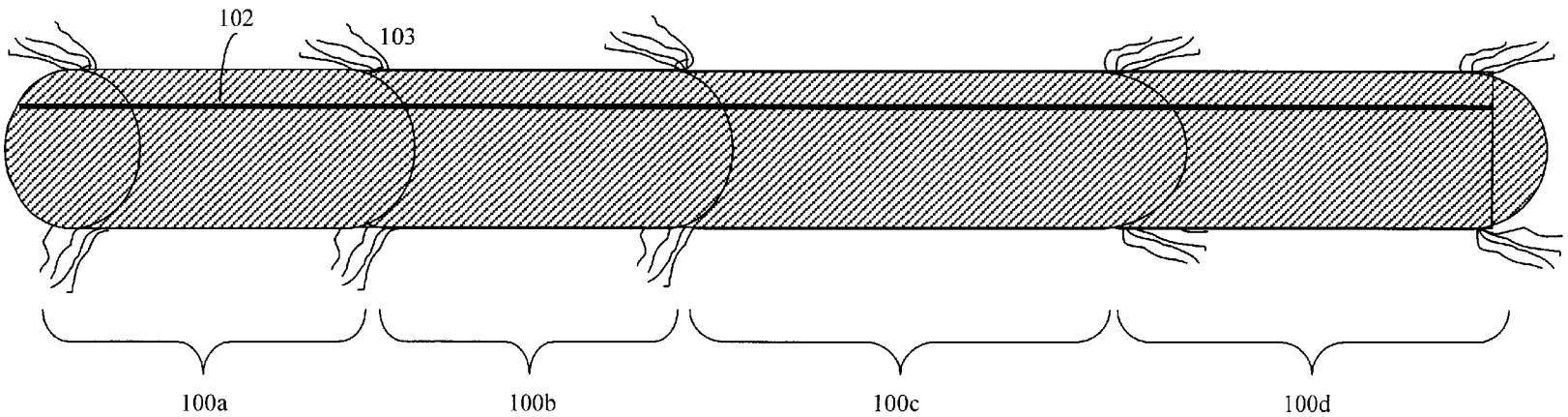
FIG. 1C illustrates a back view of the present invention as depicted in FIG. 1A.

Furthermore, in FIGS. 1A and 1C, the crib bumper's versatility, to be one continuous unit that fits the entirety of the crib or to be separate individual units which attach to different sections of the interior of the crib, is shown. In one embodiment, the crib bumper is one continuous unit which can be placed into a crib. In another embodiment, the crib bumper is capable of separating into individual components, such as 100*a*, 100*b*, 100*c*, and 100*d*. These individual components 100*a*, 100*b*, 100*c*, and 100*d* are able to independently attach to the crib's surroundings or to combine into one long bumper that would fit into the interior of the crib.

FIG. 1B illustrates a partially exposed perspective view of another embodiment of the invention. In this embodiment, the fabric cover comprises of five layers: the first layer is an initial fabric layer 105 having a front 105*a* and back side 105*b*, the second layer is a see-through interfacing layer 106, the third layer is a backing layer 107, the fourth layer is the bumper batting 108 and the fifth layer is an overall containing fabric layer 109. A receptacle 107*a* for holding photographs exists between the interfacing layer 106 and the backing layer 107.

The initial fabric layer 105 is made of any non-toxic, washable material, preferably any type of infant bedding material, most preferably cotton or a cotton blend. In FIG. 1A, the initial fabric layer 10 as a shape cut into or framed within itself. Where a plurality of shapes, including but not inclusive to the following: geometrical, oblique, circles, alphabetical, animal shapes, holiday shapes and religious shapes can be used. Once a shape is cut into the fabric that shape should be tapered or reinforced so that no fringes or loose threads hang around the edges of the cut shape in the fabric. Fraying of the fabric should also be avoided. For example, reinforcement or tapering of the fabric will prevent fraying. Additionally, the initial fabric layer 105 can be a colored fabric or a white fabric. Examples of suitable colors include baby blue, pink, or yellow or any primary color, such as, red, blue or green.

The backing layer 107 is made from any material able to support the weight of the object inserted into the framing, preferably a strong durable natural or synthetic, or combination thereof, fabric, and most preferably, cotton material, cardboard material or any derivative thereof. The arrangement of these layers creates a receptacle 107*a* for interchangeably displaying graphic material therein. The opening of the receptacle 107*a* allows for objects such as photos to be deposited into the receptacle 107*a*.

The bumper batting 108 is a soft non-toxic and washable material, preferably a plush cotton matter, filling the fabric cover located between the backing layer 107 and the overall containing fabric layer 109.

The overall containing fabric layer 109 is made of any non-toxic, washable material, preferably any type of infant bedding material, most preferably cotton or a cotton blend. This layer 109 compliments the initial fabric layer 105 and may be made of the same fabric as the initial fabric layer 105 or another acceptable fabric. In FIG. 1C, the overall containing fabric layer 109 is the back view of the invention in this embodiment.

In the first embodiment, the initial fabric layer's back side 105*b* is attached to the see-through interfacing layer 106, such that the shapes cut into the initial fabric layer's back side 105*b* are completely covered by the see-through interfacing layer 106. All the edges and sides of the see-through interfacing layer 106 are directly joined to the back side of the initial fabric layer 105*b* by a connective means, such as sewing or gluing the second layer to the first.

The backing layer 107 overlaps the see-through interfacing layer 106 such that a rectangular or square coverage exists around every shape or frame covered by the see-through interfacing layer 106. The four sided coverage of the backing layer 107 is only enclosed on three sides around each shape that is viewed from the see-through interfacing layer 106. The one remaining side is free from all contact and attachment to the other layers. Thus it is called the "free side."

The free side is the opening of the receptacle 107*a* which houses items inserted into the space between the see-through interfacing layer 106 and the backing layer 107. Thus, pockets for the interchangeably displayed graphic material are formed. Pockets are object holding units. In this embodiment, the receptacle 107*a* is a pocket for inserting the graphic material through one opening located above the see-through interfacing layer 106 and the backing laying 107.

Finally, another piece of fabric, the overall containing fabric layer 109 is attached to all the edges of the initial fabric layer's back side 105*b* creating a pillow-like or cushion-like shape, such that there is space for the bumper batting 108 to fit into the bumper fabric cover and the see-through interfacing layer 106 and the backing layer 107 are encased within the overall containing fabric layer 109.

The frontal view of the bumper fabric cover at this point is the initial fabric layer 105 with the cut out shapes and located behind it is the clear film of the see-through interfacing layer 106, so that any item placed behind the see-through interfacing layer 106 is visible and framed by the shape cut into the initial fabric layer 105. The backing layer 107 is visible when no item is placed into the receptacle 107*a*. The backing layer 107 may have images or designs which are a visual stimulus for the infant so that if the receptacle 107*a* is empty the infant will still view a design or image in the receptacle 107*a*. The bumper batting 108 sit snug behind the backing layer 107. And, the overall containing fabric layer 109 attached to the initial fabric layer 105 contains all the layers within itself.

FIG. 1C illustrates the back view of the same embodiment of the invention where the overall containing fabric layer 109 is the back cover of the entire photodisplaying crib bumper. The overall containing fabric layer 109 has a holding means 102 attached to it. The fabric cover and the bumper batting 108 is kept in place inside the fabric cover by the holding means 102, which includes but is not limited to the following or a combination of the following: zippers, buttons, overlapping fabric, strings, Velcro-like fastener or snaps. Furthermore, the crib bumper will attach to the interior surrounding of the crib by the attachment means 103 (i.e. tying the linen strings to the crib). The attachment means 103 may be connected to the overall containing fabric layer 109 or the initial fabric layer 105.

Additionally, in another embodiment of the invention (not shown in the drawings), the fabric layers are bound as explained below. Wherein bound is defined as binding or basting fabric together. The initial fabric layer 105 has a cut out shape where the shape is tapered or reinforced so that no fraying of the shaped area exists. The see-through interfacing layer 106 is laid directly over the initial fabric layer 105 such that it covers the cut out shape area. The backing fabric layer 107 with the same exact shape cut out as the initial fabric layer 105 is laid directly over the see-through interfacing layer 106. The bumper batting 108 has the exact shape cut out as the initial fabric layer 105 and the backing fabric layer 107. The backing fabric layer 107 overlaps and folds around the bumper batting's shaped edges such that the bumper batting 108 is not visible through the cut out shaped opening in the initial fabric layer 105. All theses layers are bound permanently on all sides, such that all the sides are enclosed and only the cut out shapes through out the different layers allow for the visibility of an object. Finally the overall containing fabric 109 is the last piece placed in the back of this embodiment such that it is not enclosed on all sides but only three sides and allows for an opening on the top to slip the objects into the crib bumper fabric cover. Notice that in this embodiment all the layered fabrics, including the initial fabric layer 105, the see-through interfacing layer 106, the backing fabric layer 107 and the bumper batting 108, as previously mentioned are bound such that all the sides are all enclosed and only the shape cut out on the initial fabric layer 105, the backing fabric layer 107 and the bumper batting 108 allow for visibility of the object through the see-through interfacing layer 106. The overall containing fabric layer 109 contains the opening for inserting the picture.

Figure 1D:
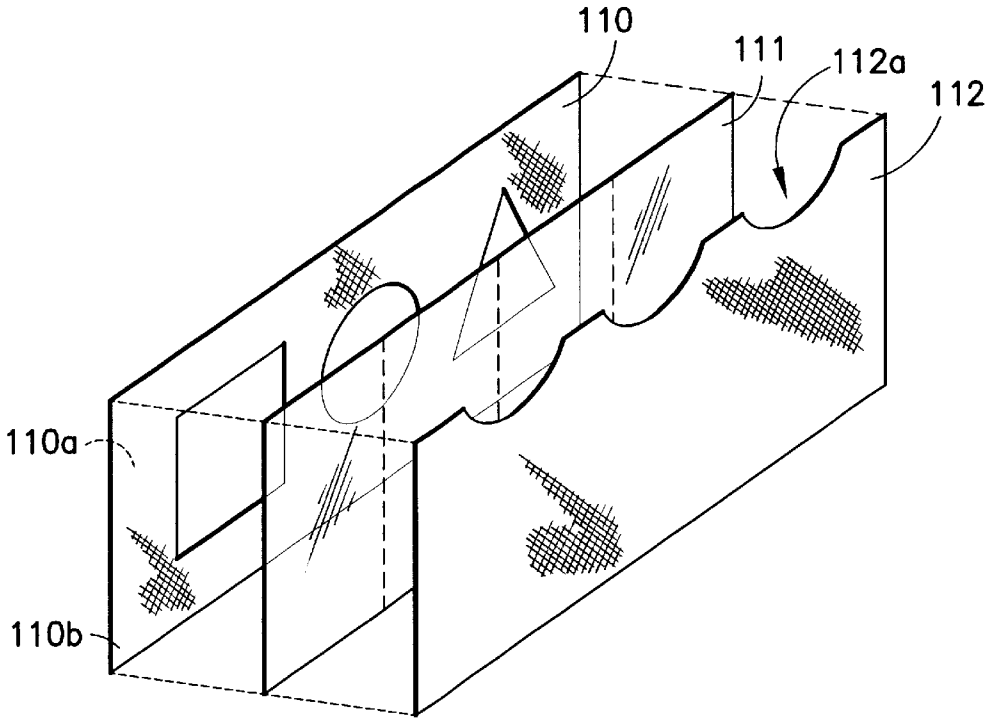
FIG. 1D illustrates a partially exposed perspective view of another embodiment of the present invention where the invention is comprised of different layers, such that a picture holding unit or pocket exists.
Figure 2A:
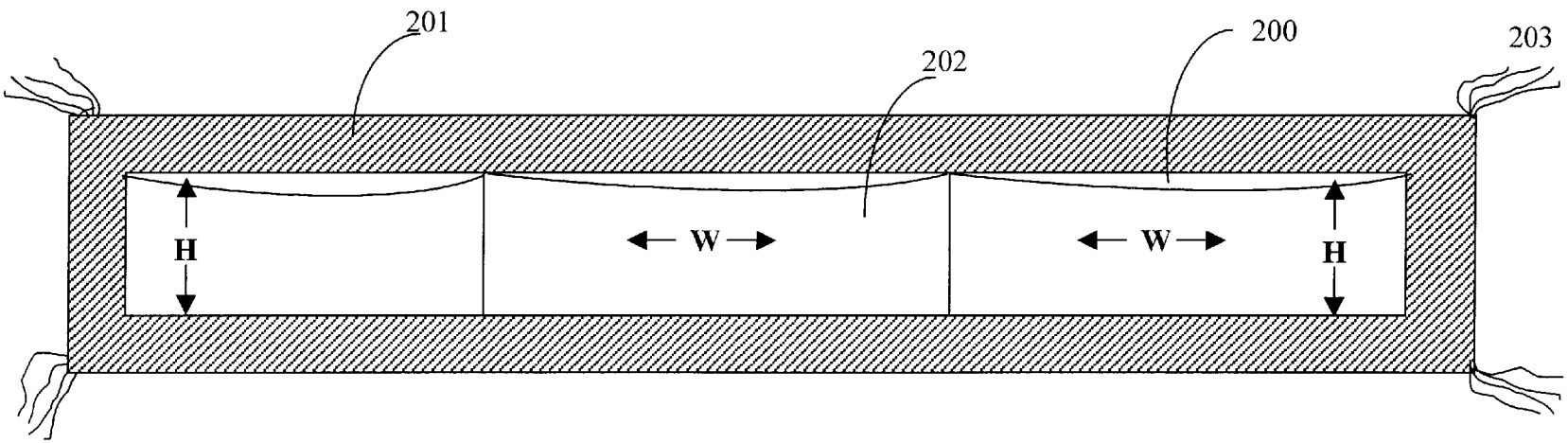
FIG. 2A illustrates an exemplary example in accordance with another embodiment of the invention. This crib bumper lays on top of an existing crib bumper or on its own along the interior surrounding of a crib. In this embodiment of the present invention, the crib bumper's picture displaying unit has a frame all-around the whole unit.

FIG. 1D illustrates a partially exposed perspective view of another embodiment of the present invention with different layers comprising the invention and the picture holding unit or pocket. In another embodiment of the invention, the crib bumper's fabric cover comprises three layers: the first layer is an initial fabric layer 110 having a front 110*a* and back side 110*b*; the second layer is a see-through interfacing layer 111; and the third layer is a backing layer 112. The object holding unit or pocket is the receptacle 112*a* for holding the interchangeably displayed graphic material. This receptacle 112*a* is located between the see-through interfacing layer 111 and the backing layer 112. In this embodiment, the crib bumper's fabric cover does not contain the crib bumper batting material 108. Therefore the overall containing fabric layer 109 and holding means 102 are not necessary. In this embodiment the attachment means 103 is connected to the initial fabric layer 110. The remainder of the functions for this embodiment are substantially the same to the first embodiment. Additionally, this embodiment of the invention may be attached to the crib's surrounding directly or it may lay on top of an existing crib bumper with or without batting. crib bumper's fabric cover comprises three layers: the first layer is an initial fabric Another embodiment of the invention is shown in FIG. 2A. FIG. 2A illustrates another embodiment of the picture displaying crib bumper where only two layers of fabric are used. The first layer is the initial fabric layer 201 with a front and back side and the second layer is a see-through interfacing layer 202. The initial fabric layer 201 is made of any non-toxic, washable material, preferably any type of infant bedding material, most preferably cotton, cotton blend or any derivative thereof. The initial fabric layer 201 can be a colored fabric or a white fabric, preferably the colors are baby blue, pink, or yellow or any primary color, such as, red, blue or green.

The second layer is a see-through interfacing layer 202 made of a clear plastic sheet. The see-through interfacing layer 202 of this embodiment has the same properties as described in the previous embodiments. However, the see-through interfacing layer 202 in this embodiment is attached to the front side of the initial fabric layer 201 via a joining means (whereas in the previous embodiment the second layer was attached to the back side of the first layer). The joining means which connects the see-through interfacing layer 202 onto the front side of the initial fabric layer 201 may be glue or thread sewn into the two fabric.

In this embodiment, the see-through interfacing layer 202 is divided into rectangular or square sections and is attached to the center of the initial fabric layer 201 such that there is more material of the initial fabric layer 201 embodying the outer perimeters of the see-through interfacing layer 202. Thus, a framing affect by the initial fabric layer 201 around the see-through interfacing layer exists 202. The rectangular sections are connected to the initial fabric layer 201 via the joining means on three sides. Thus, one side of the rectangular section is not connected or attached to the initial fabric layer 201. This side is the free side 200.

The free side 200 is the opening of the receptacle, created by the arrangement of the see-through interfacing layer 202 and the initial fabric layer 201, which houses items inserted into the space between the see-through interfacing layer 202 and the initial fabric layer 201. In this embodiment, the receptacle includes a pocket for inserting the graphic material through one opening in front of the initial fabric layer 201.

One example of this embodiment of the invention exists where the see-through interfacing layer 202 is a plastic sheet divided into units that are six (6) inches wide and four (4) inches long for every unit. These units are attached into the middle of the initial fabric layer 201 with one (1) inch all of the initial fabric layer 201 bordering the plastic sheet.

Furthermore, the four (4) by six (6) units are four sided rectangular shaped units. Three sides of one unit are sewn or glued to the initial fabric layer 201 while allowing one side of the plastic unit free 200. This free side 200 is the opening to insert interchangeably displayed graphic materials. Additionally, the initial fabric layer 201 has a border or fabric framing, preferably about an inch, around every side of the see-through interfacing layer plastic sheet 202. Thus, a pocket or jacket to hold items exists in the crib bumper fabric cover.

An alternative feature exists for this embodiment such that there is a way to close the top of the receptacle to prevent the infant from getting in and taking objects out of the receptacle. This would be known as the closing means. For example, the free side 200 can be tucked into another layer framing around the photodisplaying receptacle or it can be snapped shut or closed by a Velcro like fastener attached to the free side 200 so that the infant cannot remove the pictures from the crib bumper.

Finally, the crib bumper's fabric cover attaches to the crib through an attachment means 203, preferably cloth string, which ties to secure the crib bumper fabric cover to the crib. The attachment means 203 in this embodiment may be located either on the front or the back side of the initial fabric layer 201. This embodiment of the current invention may be added to an existing bedding set.

Figure 2B:
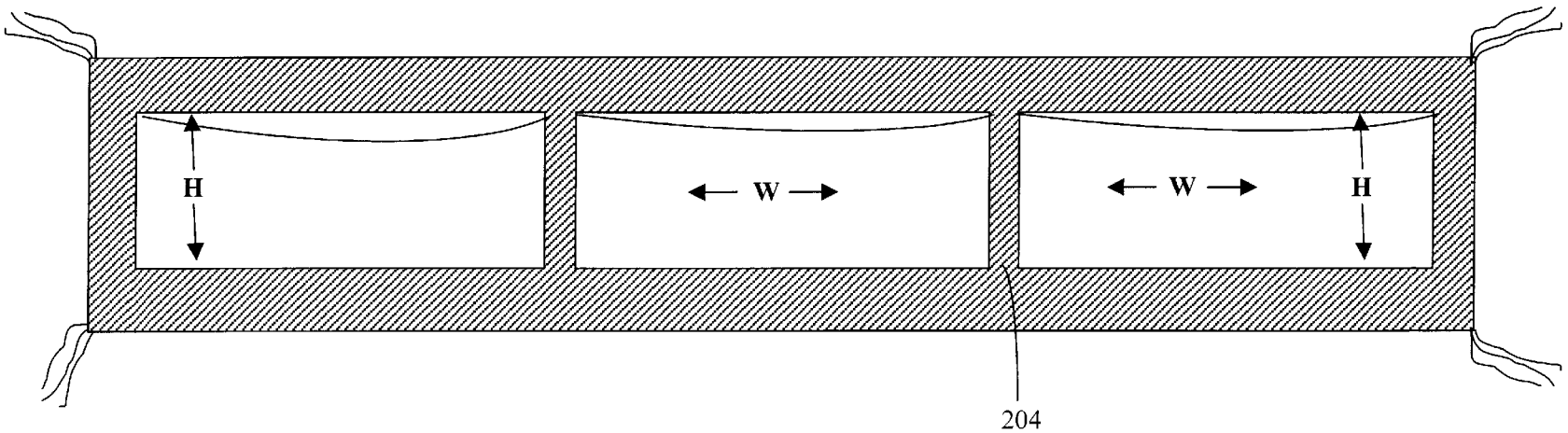
FIG. 2B illustrates an exemplary crib bumper in accordance with another embodiment of the invention which lays on top of a crib bumper or on its own along the interior surrounding of a crib. In this embodiment of the present invention, the crib bumper's picture displaying unit has a frame around each individual picture in the unit, such that the pictures are individually framed.

FIG. 2B illustrates another embodiment of this invention where the pockets or picture holding units are framed individually between each unit 204 and around the entire plastic sheet 202. A strip of fabric 204, preferably about half an inch, divides each unit. One embodiment of the individually framed units exists by having strips or pieces 204 of the initial fabric 201 sewn or glued onto one of the sides of the unit to create a framed look.

In another embodiment of the invention where individually framed units exists, the plastic sheet 202 is cut into any acceptable rectangles size which holds picture, including wallet size, 3×5, 4×6, 5×7, 8×10 and is sewn on three sides onto the initial fabric layer 201 leaving, preferably about half an inch between all of the units where the fabric 201 lays.

Figure 3A:
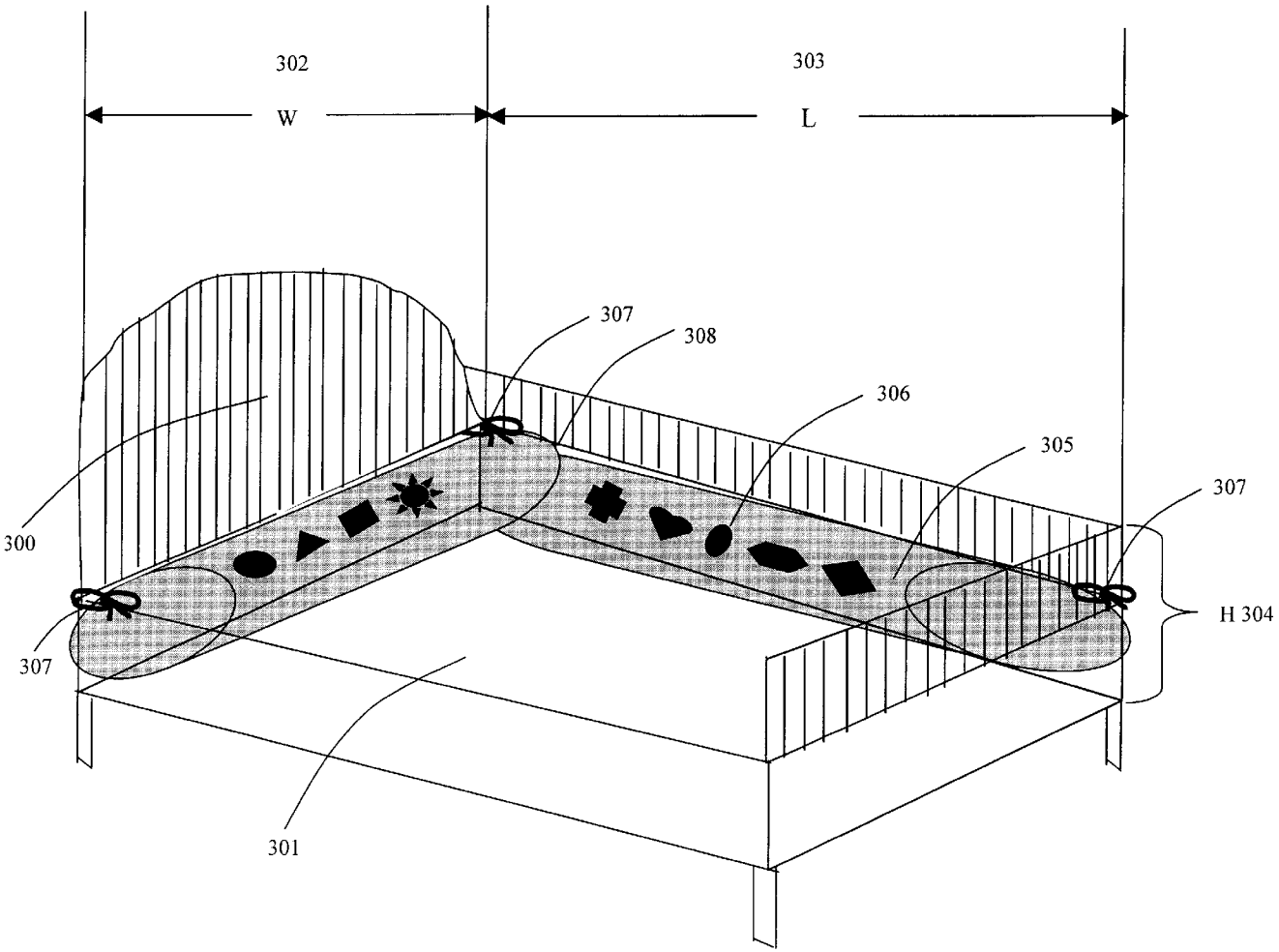
FIGS. 3A, 3B and 3C illustrate how the present embodiments of the invention are attached and positioned in the interior of a crib.

FIG. 3A illustrate how an embodiment of the invention is attached and positioned in the interior 301 of a crib by an attachment means 307 directly to the crib surrounding 300 and 308 (either the rails 308 or the crib headboard 300). In FIG. 3A, the fabric cover 305 encases bumper batting. The bumper 305 can be any size that allows fitting into the interior 301 of a crib. Such that the width 302, length 303 and height 304 of the bumper permits the bumper to be positioned within the crib. Additionally the bumper contains shapes 306 already cut into the fabric to frame the graphic material which can be inserted into the bumper.

Figure 3B:
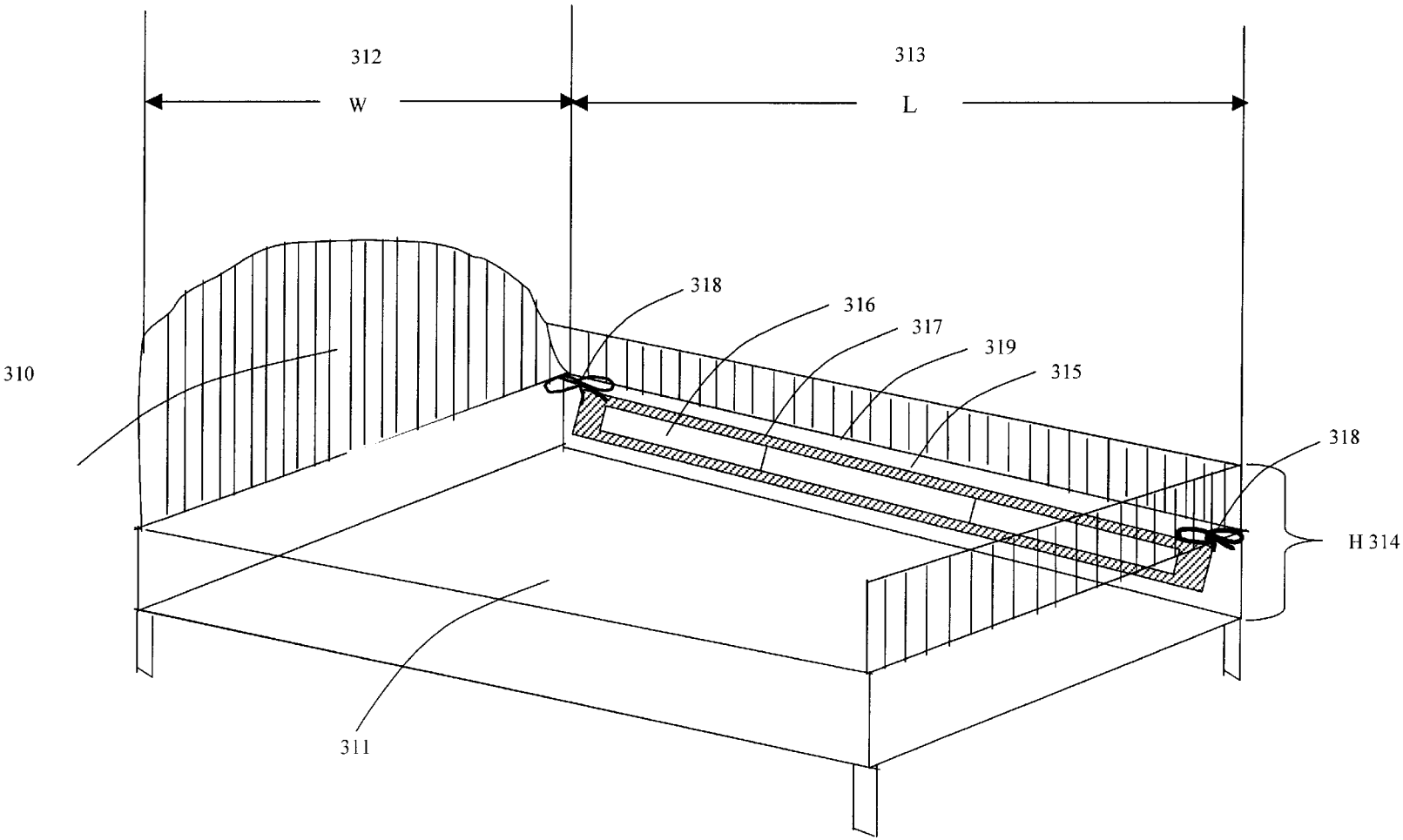

FIG. 3B illustrates how another embodiment of the invention is attached and positioned in the interior 311 of a crib where the crib bumper 315 is directly attached to the crib surrounding 310 and 319 (either the crib's rail 319 or the crib headboard 310) by an attachment means 318. The crib bumper fabric cover 315 is made of two layers: the initial fabric layer 317 and the see-through interfacing layer 316. The bumper 315 can be any size that allows fitting into the interior 311 of a crib. Such that the width 312, length 313 and height 314 of the bumper permits the bumper to be positioned within the crib.

Figure 3C:
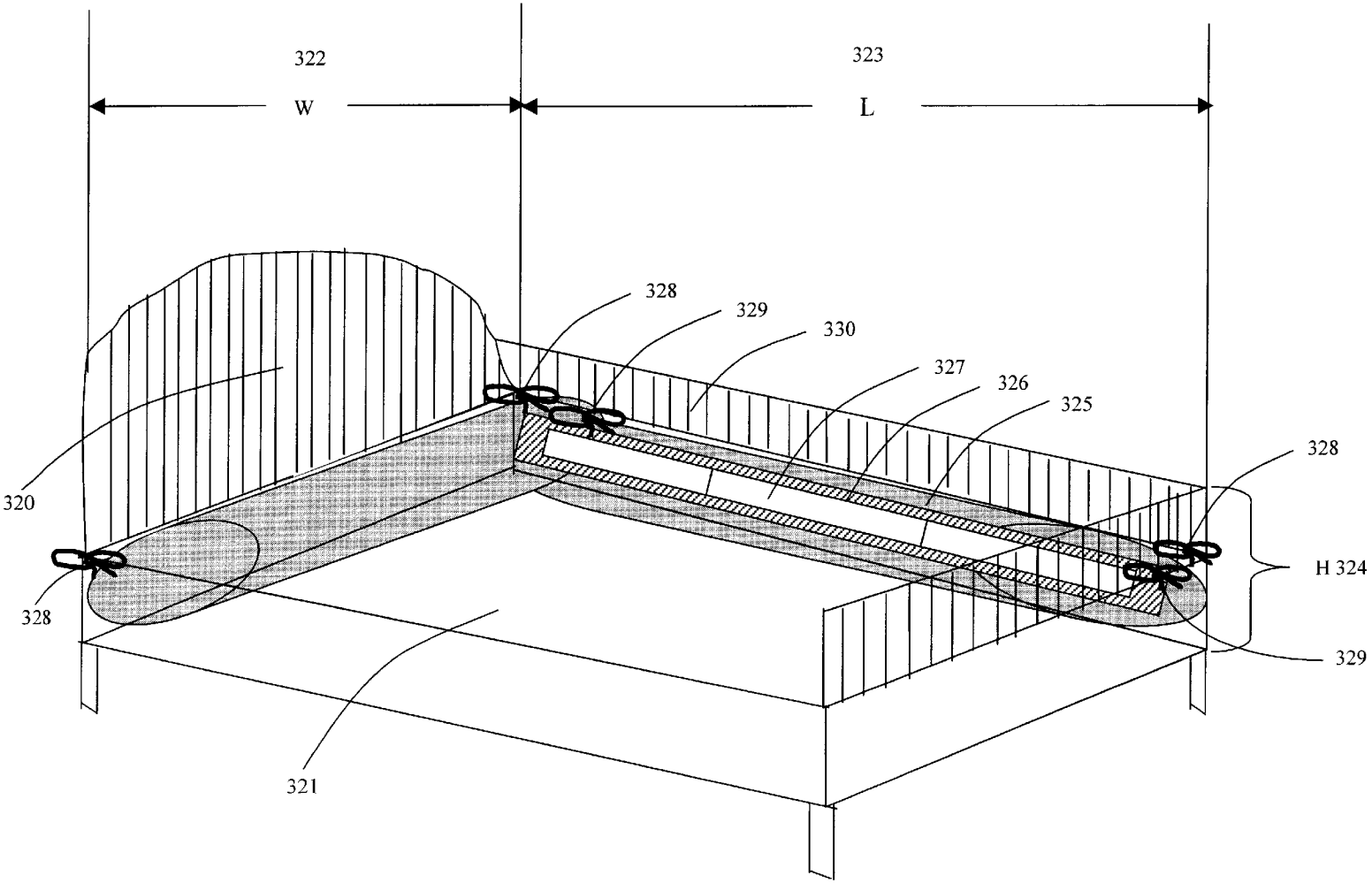

FIG. 3C illustrates how the present embodiment of the invention crib bumper$_2$ 326, not containing bumper batting, is attached and positioned in the interior 321 of a crib by an attachment means 329. Here the current invention 326 is added over an existing crib bedding set, crib bumper$_1$ 325 such that crib bumper$_2$ 326 sits on top of crib bumper$_1$ 325. Crib bumper$_1$ 325 is directly attached to the crib surrounding 320 and 330 (either the crib's rail 330 or the crib headboard 320) by attachment means 328 for the crib bumper$_1$ 325. The crib bumper fabric cover 326 is made of two layers: the initial fabric layer 326*a* and the see-through interfacing layer 327. The bumpers 326 and 325 can be any size that allows fitting into the interior 321 of a crib, such that the width 322, length 323 and height 324 of the bumper permits the bumper to be positioned within the crib.

In operation, one can use the above described invention to provide an infant visual stimulus by displaying a crib bumper fabric cover with pictures suitable for displaying to the infant.

This invention is able to visually stimulate the newborn baby's mind since it can display pictures. As the visual activity of the child improves, the caretakers can change the pictures, with more detailed pictures of flowers, shapes, colors, or even places the baby will be traveling to, etc. The caretaker is also able to substitute developmentally appropriate learning graphics into the picture displaying units. In the baby's first through second year, the caretakers can place index cards with letters, numbers, shapes, etc. into the picture displaying units. The invention provides toddlers with an opportunity to recognize the alphabet, words, numbers, their name, etc. Thus, the invention provides the ability to change the content of the display in the crib bumper.

Additionally, the personalized images chosen by the caretakers may convey different information important to be passed on to the child. For example, pictures of relatives, family members, or friends may be displayed to infants to facilitate their association and bonding and aid in reducing stranger anxiety to these individuals. Children who are not necessarily geographically close to other family members may also become visually familiarized with these persons if the pictures of their faces are placed in the displaying unit of the crib bumper.

An advantage of this invention is that it is placed inside the crib which makes it possible for the infant's daily observation. Infants will innately focus on the pictures while they are in the crib. This invention provides a convenient way to daily enhance a child's visual activity through educational stimulus, engaging them and stimulating them through mental associations.

I claim:

1. A crib bumper comprising:

a fabric cover including at least one receptacle for holding and displaying an object positioned along an interior surrounding of a crib and a means for attaching the crib bumper along an interior surrounding of the cribs wherein the receptacle is configured to allow for viewing of the object therein and includes a see-through interfacing layer located in front of the object.

2. The crib bumper according to claim 1, wherein the fabric cover encompasses a bumper batting.

3. The crib bumper according to claim 2, wherein the bumper batting is inserted into the fabric cover and is held in place by a holding means such that the fabric cover can be easily removed and separated from the bumper batting.

4. The crib bumper according to claim 3, wherein the holding means is selected from the group consisting of zippers, buttons, overlapping fabric, strings, Velcro-like fastener or snaps.

5. The crib bumper according to claim 1, wherein the receptacle is a pocket on the fabric cover for displaying items.

6. The crib bumper according to claim 1, wherein the receptacle is attached to the fabric cover for interchangeably displaying the object therein.

7. The crib bumper according to claim 1, wherein the attachment means is a string that allows one to tie the bumper to the crib.

8. A crib bumper according to claim 1, wherein the fabric cover comprises at least-two layers, including an initial fabric layer and the through interfacing layer.

9. The crib bumper according to claim 8, wherein the see-through layer is attached to the front side of the initial fabric layer via a joining means.

10. The crib bumper according to claim 9, wherein the joining means includes glue or thread.

11. The crib bumper according to claim 10, wherein the see-through interfacing layer is divided into rectangular or square sections and is attached to the center of the initial fabric layer such that there is more material of the initial fabric layer embodying an outer perimeter of the see-through interfacing layer leaving a framed effect around the entire see-through interfacing layer.

12. The crib bumper according to claim 11, wherein a framing exists with the initial fabric layer around the see-through interfacing layer such that the rectangular sections are connected to the initial fabric layer via the joining means on three sides of the section.

13. The crib bumper according to claim 11 or 12, wherein one side of the rectangular section of the see-through interfacing layer is not connected or attached to the initial fabric layer and is called the free side.

14. The crib bumper according to claim 9, wherein a receptacle is framed individually along the entire see-through interfacing layer such that pieces of the initial fabric layer divides each receptacle.

15. The crib bumper according to claim 9, wherein the receptacles are individually framed by strips of the initial fabric attached onto one of the sides of the receptacle by a joining means to create a framed appearance.

16. The crib bumper according to claim 9, wherein a receptacle is individually framed such that the see-through interfacing layer is cut into four rectangles and three sides are attached onto the initial fabric layer by a joining means.

17. The crib bumper according to claim 9, wherein a means to close the top of the receptacle exists so as to prevent access to and removal of the objects from the crib bumper.

18. The crib bumper according to claim 1, wherein the fabric cover includes means for attaching and positioning the crib bumper to another crib bumper already positioned within the crib and wherein the receptacle for holding and displaying the items is on top of the fabric cover.

19. The crib bumper according to claim 1, wherein the fabric cover comprises at least three layers, including an initial fabric layer, a see-through layer, and a backing layer.

20. The crib bumper according to claim 19, wherein the see-through layer is directly attached to the front side of the initial fabric layer, such that three edges of the see-through layer are attached into the initial fabric layer and the same fabric used for the initial fabric layer is used to border around the see-through layer to create a framed appearance and the backing layer attaches directly to the back side of the initial fabric layer to create a pocket to insert objects on the front of the initial fabric layer.

21. A crib bumper comprising:

a fabric cover including at least one receptacle for holding and displaying an object positioned along an interior surrounding of a crib, wherein the receptacle is configured to allow for viewing of the object therein and means for attaching the crib bumper along an interior surrounding of a crib, wherein the fabric cover further comprises an initial fabric layer having a front and back side, a see-through interfacing layer and a backing layer, and wherein the receptacle is defined by the area between see-through interfacing layer and the backing layer.

22. A crib bumper according to claim 21, further comprising an overall containing fabric layer.

23. The crib bumper according to claim 22, wherein the overall containing fabric layer is attached to the back side of the initial fabric layer and defines an area to encase a bumper batting, the see-through interfacing layer and the backing layer.

24. The crib bumper according to claim 23, further comprising holding means attached to the overall containing fabric layer to keep a bumper batting inside the fabric cover.

25. The crib bumper according to claim 22, wherein an attachment means are connected to the overall containing fabric layer.

26. The crib bumper according to claim 21, wherein attachment means are connected to the initial fabric layer.

27. The crib bumper according to claim 21, wherein the initial fabric layer has at least one of a plurality of openings framed within.

28. The crib bumper according to in claim 27, wherein the openings include a plurality of shapes.

29. The crib bumper according to claim 28, wherein the plurality of shapes are selected from the group consisting of geometrical, obliques, circles, alphabetical, animal shapes, and religious symbols.

30. The crib bumper according to 21, claim 1 wherein the see-through interfacing layer allows for objects to be viewed through the fabric cover while protecting and preventing access to the item.

31. The crib bumper according to claim 21, wherein the see-through interfacing layer is made from a pliable, flexible, washable, clear, non-toxic plastic.

32. The crib bumper according to claim 21, wherein the see-through interfacing layer has edges which are all directly attached to the initial fabric layer's back side by a joining means and the backing layer is positioned directly behind the see-through interfacing layer, overlapping the see-through interfacing layer and attached to the initial fabric layer's back side such that the at least one receptacle defined by the area between the see-through interface and the backing layer and objects are inserted in the at least one receptacle.

33. The crib bumper according to in claim 32, wherein the joining means includes glue or stitching, to attach the layers to each other.

34. A crib bumper comprising:

a fabric cover including at least one receptacle for holding and displaying an object positioned along an interior surrounding of a crib, wherein the receptacle is configured to allow for viewing of the object therein and means for attaching the crib bumper along an interior surrounding of a crib, wherein the fabric cover further comprises an initial fabric layer having a front and back side, a see-through interfacing layer, a bumper batting, a backing layer, and an overall containing fabric layer, and wherein the initial fabric layer, the see-through interfacing layer, the backing layer, and the bumper batting are all bound together on all four sides with a at least one opening cut into each of the initial fabric layer, the backing layer, and the bumper batting, wherein the backing layer covers the bumper batting's edges and the overall containing layer is attached to the back of the bumper batting such that three sides of the overall containing layer are bound and one side is left free to insert objects into the crib bumper.

35. The crib bumper according to in claim 1 or 34, wherein the see-through interfacing layer is made of flexible, pliable, washable, non-toxic, clear plastic.

36. The crib bumper cover according to any one of in claim 21 or 34, wherein the objects are removable from their receptacles and wherein said objects are selected from the group consisting of photographs, words, alphabetical letters, mirrors, pictures and colors according to the child's developmental stage.

37. A method to enhance a child's development and association through visual stimulus using a crib bumper, the crib bumper comprising: a fabric cover including at least one receptacle for holding and displaying an object positioned along an interior surrounding of a crib and means for attaching the crib bumper along an interior surrounding of a crib, wherein the receptacle is configured to allow for viewing of the object therein and includes a see-through interfacing layer located in front of the object; the method comprising the following steps:

placing a child in a crib;

attaching said crib bumper in said crib; and exposing the child in the crib to the objects held and displayed by the at least one receptacle of the crib bumper.

* * * * *